US006435221B1

(12) United States Patent
Waldrop et al.

(10) Patent No.: US 6,435,221 B1
(45) Date of Patent: Aug. 20, 2002

(54) LOW ABRASION ELASTOMERIC FABRIC

(75) Inventors: Anthony R. Waldrop, Easley; Bernhard Zeiler; Steven W. Josey, both of Moore, all of SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/078,184

(22) Filed: Feb. 19, 2002

Related U.S. Application Data

(60) Provisional application No. 60/270,684, filed on Feb. 22, 2001.

(51) Int. Cl.[7] ..... A47C 3/00

(52) U.S. Cl. ..... 139/422; 139/421; 139/383 R; 442/182; 442/208; 442/209

(58) Field of Search ..... 139/353 R, 384 R, 139/419, 420 R, 421, 422; 442/182, 192, 203, 208, 209

(56) References Cited

U.S. PATENT DOCUMENTS

| | | | | | |
|---|---|---|---|---|---|
| 3,965,943 | A | * | 6/1976 | Goff et al. | 139/421 |
| 4,207,885 | A | * | 6/1980 | Hampton et al. | 139/419 |
| 4,328,840 | A | * | 5/1982 | Fontana | 139/419 |
| 4,328,841 | A | * | 5/1982 | Fontana | 139/419 |
| 4,604,315 | A | * | 8/1986 | McCall et al. | 139/421 |
| 5,134,006 | A | * | 7/1992 | Irvin | 198/847 |
| 5,324,578 | A | * | 6/1994 | Weinberg | 428/74 |
| 6,035,901 | A | * | 3/2000 | Stumpf et al. | 139/383 R |

* cited by examiner

*Primary Examiner*—A Vanatta
*Assistant Examiner*—Robert H. Muromoto, Jr.
(74) *Attorney, Agent, or Firm*—Terry T. Moyer; Jeffrey E. Bacon

(57) ABSTRACT

An elastomeric fabric woven in a leno weave, with the warp yarns being elastomeric yarns. The elastomeric warp yarns have a minor axis disposed in the direction perpendicular to the fabric surface. The fabric is calendered to reduce the thickness of the elastomeric yarns along the minor axis at the cross-over of the warp yarns in the leno weave.

5 Claims, 3 Drawing Sheets

LOW ABRASION ELASTOMERIC FABRIC

PRIORITY

Priority is hereby claimed under 35 USC §119 to abandoned provisional application Serial No. 60/270,684, filed on Feb. 22, 2001, which is hereby incorporated herein by specific reference thereto.

BRIEF DESCRIPTION OF THE DRAWING

Elastomeric fabrics are typically fabrics manufactured with a monafilament elastomeric yarn disposed in at least one direction of the fabric. Elastomeric fabrics have found wide spread use in areas such as seating. In seating, elastomeric fabric can provide both the exterior surface, and the support for the user of the seat. However, it has been discovered that elastomerics can create a higher abrasion on other fabrics that engage the elastomeric fabric, such as on garments of the users sitting in the seat. Therefore, there is a need for elastomeric fabrics which have a lower abrasion factor.

BRIEF DESCRIPTION OF THE DRAWING

Figure 1:
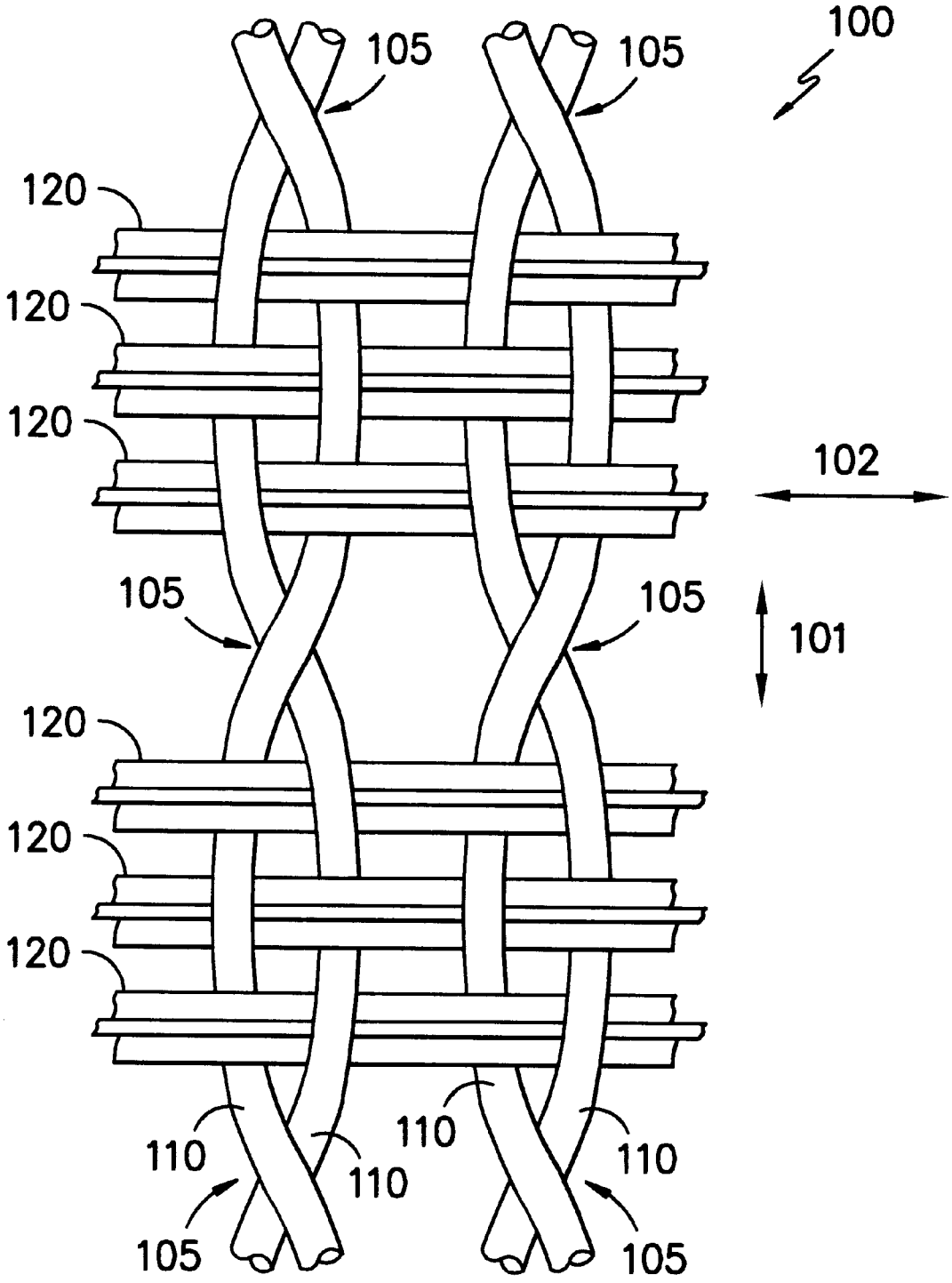

The invention can be better understood with reference to the drawings, in which:

FIG. 1 is a leno weave elastomeric fabric incorporating the present invention.

Figure 2:
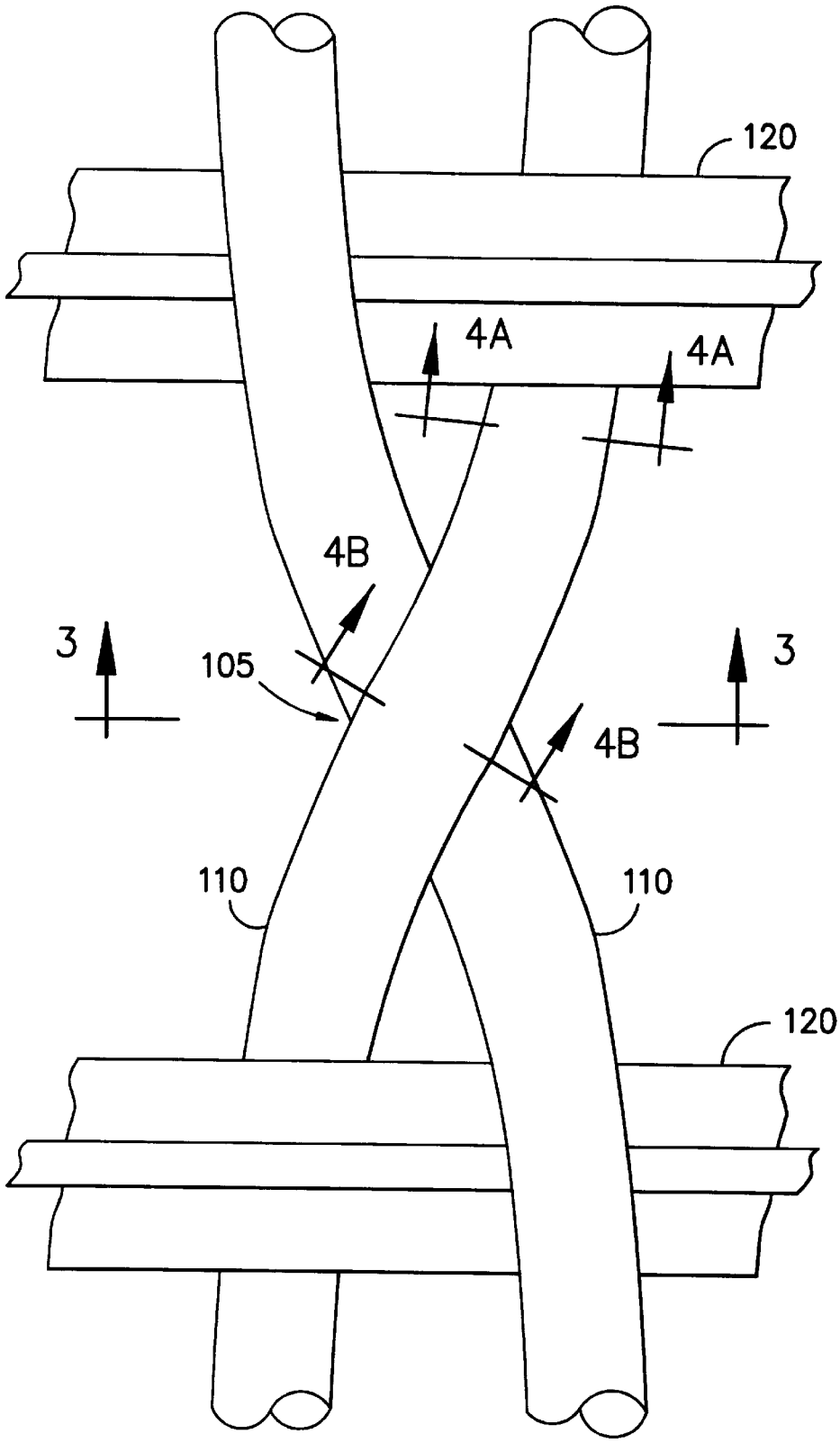

FIG. 2 is an enlarged plan view of a portion of the fabric from FIG. 1, illustrating warp yarns at the point of intersection where the warp yarns cross over each other.

Figure 3:
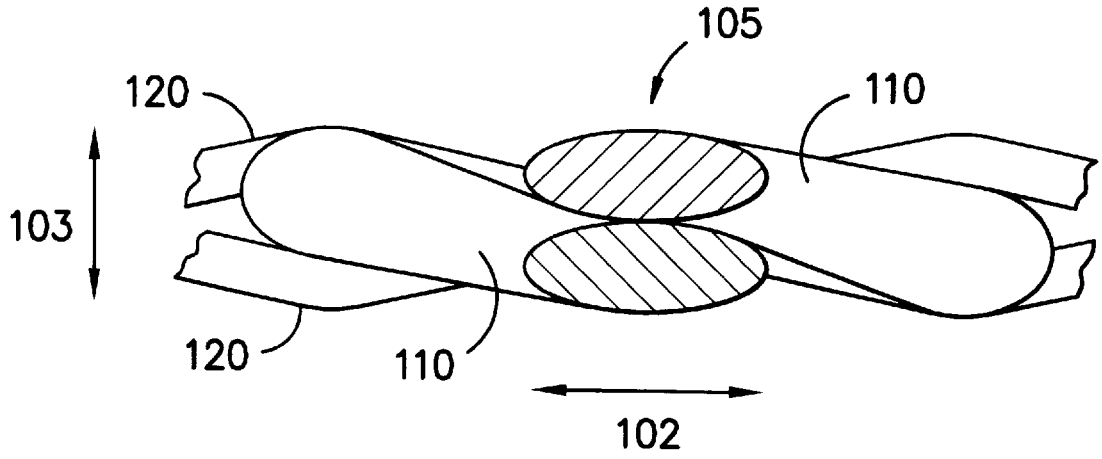

FIG. 3 is an enlarged cross-sectional view of the portion of the fabric along line 3—3 in FIG. 2.

Figure 4A:
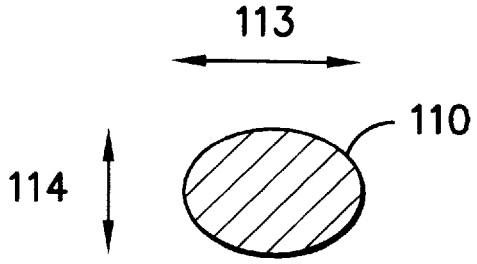
Figure 4B:
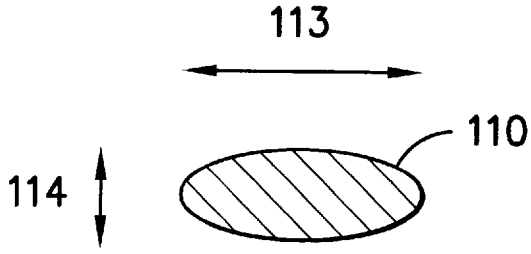

FIGS. 4A and 4B are enlarged cross-sectional views of the warp yarns along section lines 4A—4A and 4B—4B, respectively, in FIG. 2.

DETAILED DESCRIPTION

Referring now to the figures, and in particular to FIGS. 1, 2, and 3, there is shown elastomeric fabric 100 having a warp direction 101, a fill direction 102, and a thickness 103. The elastomeric fabric 100 generally includes warp yarns 110 in the warp direction 101, and fill yarns 120 in the fill direction 102. As illustrated, the elastomeric 100 is a leano weave fabric, with the warp yarns 110 crossing at various cross over points 105 between individual or groups of fill yarns 120 to secure the fill yarns 120 in position. However, it is contemplated that the present invention can be any type of weave necessary to form the elastomeric fabric.

The warp yarn 110 comprises an elastomeric monofilament, single component yarn. The warp yarn 110 can be an elliptical cross-section with a major axis 113 and a minor axis 114. In one embodiment, the ratio of major axis to minor axis of the warp yarn is about 1.6. In one embodiment, the warp yarn 110 is a Riteflex or Hytrel extruded and drawn copolyester yarn. In another embodiment, the warp yarn can be a bicomponent elastomeric yarn, such as a core/sheath yarn.

Elastomeric yarns, as used herein, means a nontextured yarn that can be stretched at room temperature to at least twenty-five percent (25%) over its original length and which after removal of the tensile force will immediately and forcibly return to within three percent (3%) of its original length. To determine if a yarn is elastomeric, ASTM Standard Test Method for Permanent Deformation of Elastomeric Yarns (D 3106-95a), which is incorporated herein in its entirety by specific reference thereto, can be used with the exception that the specimen is stretched to a length of 25% over the original length of the specimen for all stretching time periods, and the elongation after stretch is determined after the longer relaxation time period.

The fill yarn 120 is a multicomponent air entangled, core and effect yarn, made of five components. The first component is a 20 denier carbon impregnated yarn for static dissipation. The second component is a 560 denier spandex yarn. The third, fourth, and fifth components are 300 denier solution dyed textured polyester yarns.

Although the present invention is illustrated as having only the warp yarns 110 as elastomeric yarns, it is contemplated by the present invention that the fill yarn 120 can be elastomeric and the warp yarn 110 nonelastomeric, or both the warp yarn 110 and the fill yarn 120 are elastomeric.

Referring now to FIGS. 4A and 4B, there is shown an enlarged cross-sectional view of the warp yarns 110 of the elastomeric fabric 100 at the point where the warp yarns 110 are not in contact, and the cross over point 105, respectively, as shown in FIG. 2. As previously discussed, various elastomeric warp yarns 110 cross over each other at the cross over points 105 to form the leno weave.

Each of the elastomeric warp yarns 110 has an elliptical cross section with the minor axis 113 generally orientated parallel to the direction of the fabric thickness 103, and a major axis 114 generally orientated perpendicular to the minor axis 113. The cross section of the warp yarn 110 shows it to have a smaller thickness along the minor axis 113 at the cross over point 105 than at other locations on the warp yarn 110. The result of the varying thickness along the minor axis 113 of the warp yarn 110 is that the overall thickness of elastomeric fabric 100 is about the same at the cross over points 105 as other areas of the fabric 100. In one embodiment, the thickness of the warp yarn 110 along the minor axis 113 at the cross over point 105 is from about 60% to about 82% of the width of the warp yarn 110 along the major axis 114, and the ratio of width in the major axis to the thickness in the minor axis of the warp yarn is from about 1.8 to about 2.1.

The fabric 100 of the present invention can be formed by weaving the elastomeric fabric with the warp yarns 110 and the fill yarns 120 in the appropriate weave style, and calendaring the fabric at room temperature. In one embodiment, a leno woven elastomeric fabric or membrane in the construction illustrated above, is formed according to the disclosure in U.S. Pat. No. 6,035,901, titled "Woven Fabric Membrane For A Seating Surface", issued to Stumpf et al. on Mar. 14, 2000, and which is incorporated in its entirety herein by specific reference hereto. After the leano elastomeric fabric or membrane is formed, it is calendered at room temperature at about 650 PSIG, in one embodiment, and at about 1300 PSIG in another embodiment. In one embodiment, the nip rollers calendering the fabric 100 are set to about 1550 pounds per linear inch, and in another embodiment the nip rollers are set to about 3100 pounds per linear inch. The room temperature is controlled to be between about 60 F. to about 100 F. In one embodiment, the fabric is calendered at least 600 PSIG at the previously specified room temperature. In one embodiment, the nip rollers calendering the fabric 100 are set to about 1425 pounds per linear inch.

In one example, a leano weave was formed and calandered to produce a fabric with 17% less thickness at the cross over point 105 than a fabric not calendered. The calendaring reduces the thickness of the fabric at the cross over point 105 from about 0.0375 to about 0.031 inches.

The fabric of the above example was pre-stretched to about 5% in the warp direction and about 20% in the fill direction, and subjected to a Martindale Abrasion Tests, as described in ASTM-4966-98, which is incorporated herein in its entirety by specific reference thereto. A control sample of the above example was also subjected to the Martindale Abrasion Test prior to the room temperature calendering of the fabric. The control sample was also pre-stretched stretched to about 5% in the warp direction and about 20% in the fill direction. Test specimens were used of 100% Worsted Wool Flannel Fabric with 77 ends per inch and 67 picks per inch, yarn size cotton warp of 19.13, yarn size system fill of 25.17, a weight of 5.26ounces per square yard, which was take from pants manufactured by Austin Reed. A failure of the test specimen is defined as a hole appearing in the specimen, as discovered by inspecting the specimen at every 2,000 cycles. It was found that the control sample caused a failure of the test specimen at about 30000 cycles, and the example calendered at room temperature caused a failure of the test specimen at about 40000 cycles.

What is claimed is:

1. A fabric having a first set of yarns and a second set of yarns interwoven in a leno weave having a fabric thickness direction, wherein various of the yarns from the first set of yarns cross over each other at cross over points to form the leno weave, wherein the first set of yarns comprise elastomeric yarns with a cross section having a yarn thickness in a minor axis oriented substantially in the direction of the fabirc thickness direction and a yarn width in a major axis oriented substantially perpendicular to the minor axis, and wherein the minimum size of the yarn thickness of the elastomeric yarns is located at the cross over points.

2. The fabric according to claim 1, wherein the yarn thickness of the elastomeric yarns at the cross over point is from about 60% to about 82% smaller than the yarn width.

3. The fabric according to claim 1, wherein the ratio of yarn width to yarn thickness of the elastomeric yarn is from about 1.8 to about 2.1 at the cross over point.

4. The fabric according to claim 1, wherein the fabric thickness at the cross over point 105 not greater than about the mean fabric thickness.

5. The fabric according to claim 1, wherein the second set of yarns includes carbon impregnated yarns.

* * * * *